US009877514B2

(12) United States Patent
Eksouzian

(10) Patent No.: US 9,877,514 B2
(45) Date of Patent: Jan. 30, 2018

(54) VAPORIZER WITH ELECTRONICALLY HEATED NAIL

(71) Applicant: Vahan Eksouzian, Glendale, CA (US)

(72) Inventor: Vahan Eksouzian, Glendale, CA (US)

(73) Assignee: Cloud V Enterprises, Glendale, CA (US)

( * ) Notice: Subject to any disclaimer, the term of this patent is extended or adjusted under 35 U.S.C. 154(b) by 312 days.

(21) Appl. No.: 14/860,688

(22) Filed: Sep. 21, 2015

(65) Prior Publication Data

US 2017/0079324 A1 Mar. 23, 2017

(51) Int. Cl.
*A24F 47/00* (2006.01)

(52) U.S. Cl.
CPC ..... *A24F 47/008* (2013.01)

(58) Field of Classification Search
CPC ..... A24F 47/008
USPC ..... 131/329
See application file for complete search history.

(56) References Cited

U.S. PATENT DOCUMENTS 4,148,326 A 4/1979 Harbaugh
4,171,703 A 10/1979 Locke
4,183,365 A 1/1980 Kelley
4,216,785 A 8/1980 Erickson et al.
4,241,741 A 12/1980 Cabados et al.
4,253,475 A 3/1981 Schreiber et al.
5,186,164 A * 2/1993 Raghuprasad .... A61M 15/0086 128/200.14
6,036,783 A 3/2000 Fukunaga et al.
6,155,540 A 12/2000 Takamatsu et al.
6,604,492 B2 8/2003 Porter et al.
6,745,763 B2 6/2004 Webb
6,834,848 B2 12/2004 Porter et al.
7,267,120 B2 9/2007 Rustad et al.
7,452,424 B2 11/2008 Okabe et al.
7,840,122 B1 11/2010 Hanrahan et al.
8,314,591 B2 11/2012 Terry et al.
8,371,290 B2 2/2013 Haveri
8,550,068 B2 10/2013 Terry et al.
8,881,737 B2 3/2014 Collett et al.
8,746,240 B2 6/2014 Terry et al.
8,757,147 B2 6/2014 Terry et al.
8,781,307 B2 7/2014 Buzzetti
8,899,239 B2 9/2014 Hon
8,851,068 B2 10/2014 Cohen et al.
8,983,282 B2 3/2015 Bishara
9,044,050 B2 6/2015 Touzjian
(Continued)

*Primary Examiner* — Tho D Ta
*Assistant Examiner* — Travis Chambers
(74) *Attorney, Agent, or Firm* — Kevin Shenkman

(57) ABSTRACT

A vaporizer comprising a mouthpiece and battery. The mouthpiece preferably includes an upper chamber and a lower chamber separated by a small distance and providing an air pathway through the length of the mouthpiece, and a cooling liquid surrounding a portion of the lower chamber. Electrically connected to the battery is a pan that includes a heating element that heats the top surface of the pan to a desired temperature for vaporizing, but not combusting, a substance desired to be inhaled. A pan protector, made of an insulating material, surrounds the sides of the pan to prevent injury to a user. The vaporizer further includes a controller for ensuring that the pan is heated only to a pre-selected temperature sufficient to vaporize, but not combust, the chosen substance.

5 Claims, 6 Drawing Sheets

(56) References Cited

U.S. PATENT DOCUMENTS

| | | | | |
|---|---|---|---|---|
| 9,095,174 | B2 | 8/2015 | Capuano | |
| 9,629,394 | B2 * | 4/2017 | Aronie | A24F 47/008 |
| 2007/0283972 | A1 * | 12/2007 | Monsees | A24F 47/006 131/273 |
| 2015/0122274 | A1 * | 5/2015 | Cohen | A24F 47/008 131/328 |
| 2015/0189919 | A1 * | 7/2015 | Liu | A24F 47/008 131/329 |
| 2015/0245658 | A1 * | 9/2015 | Worm | A24F 47/008 131/328 |
| 2015/0282526 | A1 * | 10/2015 | Wu | A61M 15/06 131/329 |
| 2015/0305403 | A1 * | 10/2015 | Coelho Belo Fernandes de Carvalho | A24F 47/008 131/328 |
| 2016/0143365 | A1 * | 5/2016 | Liu | A24F 47/008 131/329 |
| 2016/0192707 | A1 * | 7/2016 | Li | A24F 47/008 131/329 |
| 2017/0013877 | A1 * | 1/2017 | Breiwa, III | A24F 47/006 |
| 2017/0055588 | A1 * | 3/2017 | Cameron | H05B 3/44 |

* cited by examiner

VAPORIZER WITH ELECTRONICALLY HEATED NAIL

BACKGROUND OF THE INVENTION

1. Field of the Invention

The present invention relates generally to the field of vaporizers used to heat solids, liquid and suspensions, such as waxes and oils, for inhalation by a user.

2. Prior Art

Vaporizers, including electronic cigarettes, have become increasingly popular over the past ten years. As consumers have become more aware of the health consequences of inhaling smoke produced by combusting tobacco and other substances, vaporizers have become a healthier alternative to cigarettes, cigars, pipes and other smoking implements. While some vaporizers are large and bulky—sometimes intended to mimic the aesthetic look of a bookah—most vaporizers are small enough to fit into a user's pocket or purse for convenience.

Vaporizers in which the solid, liquid or suspension material sought to be vaporized is placed onto a pre-heated surface, however, have remained bulky, expensive, dangerous and inconvenient. The drawbacks of such vaporizers is best understood with reference to FIG. 1, which depicts a conventional pre-heated surface vaporizer. The prior art pre-heated surface vaporizer 3 includes a slide 7. Slide 7 is heated by a torch 9 that generally employs butane or another combustible hydrocarbon. Once the slide 7 is sufficiently heated by torch 9, a user may place a substance desired to vaporized in the slide 7. When the substance is placed in contact with slide 7, it quickly vaporizers due to the high temperature of the slide 7. Slide 7 includes a small opening which allows airflow through the slide to the interior of vaporizer 3. Vaporizer 3 includes a mouthpiece 5 that also provides for airflow through the interior of the vaporizer 3 to the mouthpiece 5. In that way, a user may inhale at mouthpiece 5 and ingest the vapor of the substance placed in the slide 7. Vaporizer 3 may be partially filled with water for the purpose of cooling the vapor before it is inhaled by the user.

While this sort of apparatus provides for creative aesthetics, it also has significant drawbacks. User of a torch 9 to heat a slide 7 is inherently dangerous because it employs a combustible hydrocarbon and results in an exposed and extremely hot slide 7, usually made of a heat conductible metal. This may be a particular concern for users who may choose to vaporize and inhale an intoxicant, as that is likely to make them more likely to be injured by open flame from the torch 9 or the exposed hot slide 7. Some prior art vaporizers include an alternative heating source, such as an electronic heat device that connects to the slide 7, however, they are generally bulky and expensive. The size of the vaporizer 3, as well as the necessity of the torch 9 or other separate heating device, make this sort of apparatus bulky, inconvenient (compared to a compact vaporizer that can fit in a user's pocket or purse), and expensive.

Furthermore, the prior art configuration depicted in FIG. 1 requires that the slide 7 have an air passage to permit inhalation of the vaporized substance from the mouthpiece 5. That air passage inevitably accumulates residue of the substance to be vaporized, whether because the slide is overheated and thus causes the substance to combust or because some of the substance is not vaporized. As a result, subsequent users of the vaporizer 3 are unwittingly exposed to vapors from a previous substance. This too is especially a problem if the vaporizer 3 is used by multiple users, particularly if some of those users use the vaporizer 3 to ingest intoxicants. Even if the substance does not accumulate in the air passage, the inclusion of an air passage may also allow unvaporized substance to drip through the slide 7. Specifically, prior to vaporizing, the viscosity of wax or oil, when it is heated, decreases, and therefore the wax or oil desired to be vaporized may fall through the air passage without being vaporized particularly if a user is providing negative pressure in the vaporizer by inhaling at the mouthpiece 5.

There exists a need for a compact vaporizer that provides the user with the ability to place a solid, liquid or suspension substance on a pre-heated pan with an airway to the user's mouth, wherein the temperature of the pan is controlled, no flame is necessary, and the pan provides for easy cleaning between uses. The present invention, the preferred embodiment of which is described herein, meets this need, and provides further advantages over the prior art, as described herein.

SUMMARY OF THE INVENTION

The present invention, or more accurately the preferred embodiment of the present invention, provides a compact vaporizer comprising a battery, mouthpiece and pan. The pan comprises a heating element electrically connected to the battery that heats the pan to a desired temperature. The pan is disposed within the vaporizer so as to provide an air pathway between the pan and the mouthpiece. The pan has no holes or passages that would allow a heated liquid or suspension material to accumulate. The mouthpiece comprises two chambers separated from one another by a small distance, and a liquid substance in the mouthpiece but outside or those two chambers. The chambers of the mouthpiece provide an air pathway from one end of the mouthpiece to the opposite end. The chambers are configured to prevent the liquid from entering either of the two chambers. The pan is controllably heated to a desired temperature, and a substance to be vaporized is placed on the pan. The temperature of the pan is pre-selected to ensure that the substance is vaporized but not combusted. A user may then inhale the vaporized substance through the mouthpiece without the vapor traveling through any passageway within the pan. Electrical power provided to the heating element is timed and shutoff after a pre-selected amount of time.

The pan is easily and conveniently attached to, and detached from, the battery housing of the vaporizer. When the pan is attached to the battery housing, it is also in electrical contact with the battery. The electrical power from the battery, is controlled by a microprocessor or similar controller. Preferably, the pan is constructed from a heat conductive material at locations where the substance to be vaporized comes into contact with the pan, and an insulator material outside of the heat conductive material. Preferably, materials are selected for the pan such that they will not degrade from heat at temperatures up to at least 1300 degrees Fahrenheit, and will not degrade or otherwise react chemically with substances commonly vaporized, including wax, oil, and e-juice.

DETAILED DESCRIPTION OF THE PREFERRED EMBODIMENT OF THE INVENTION

Figure 1:
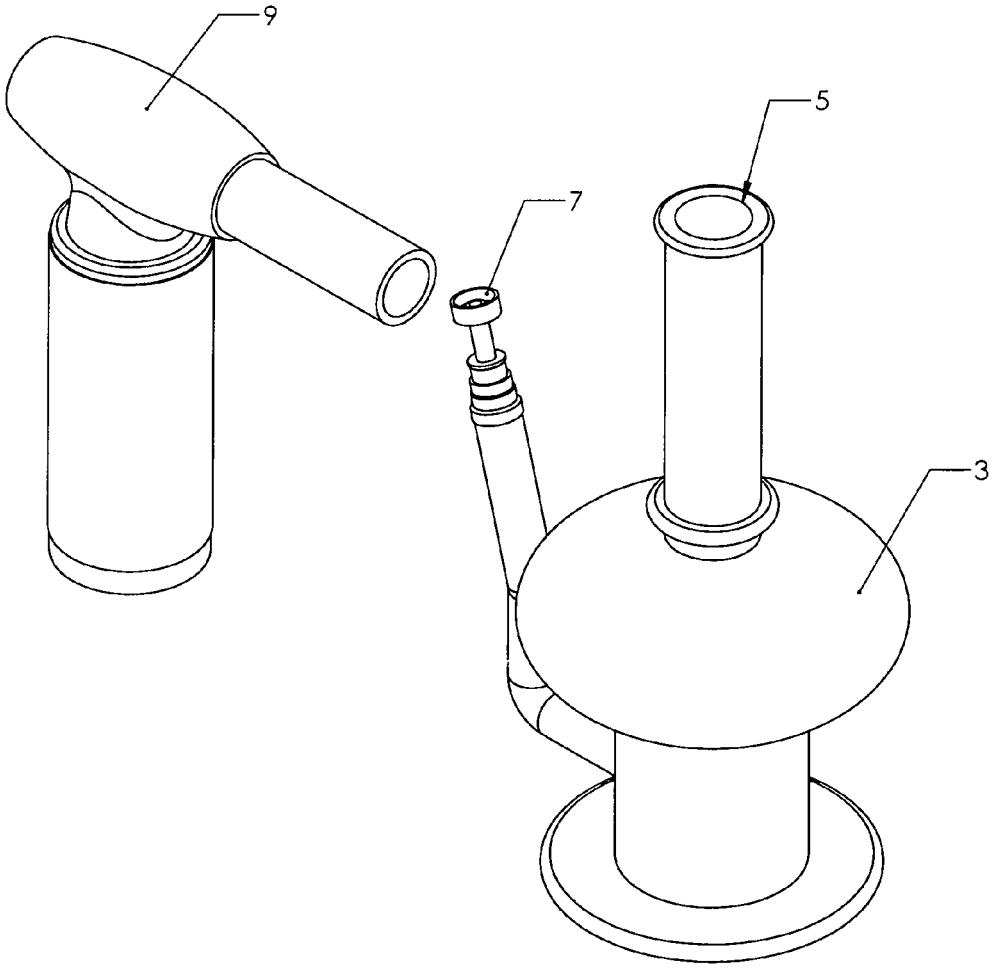
FIG 1 PRIOR ART
FIG. 1 is a perspective view of a conventional vaporizer and torch consistent with the prior art.
Figure 2:
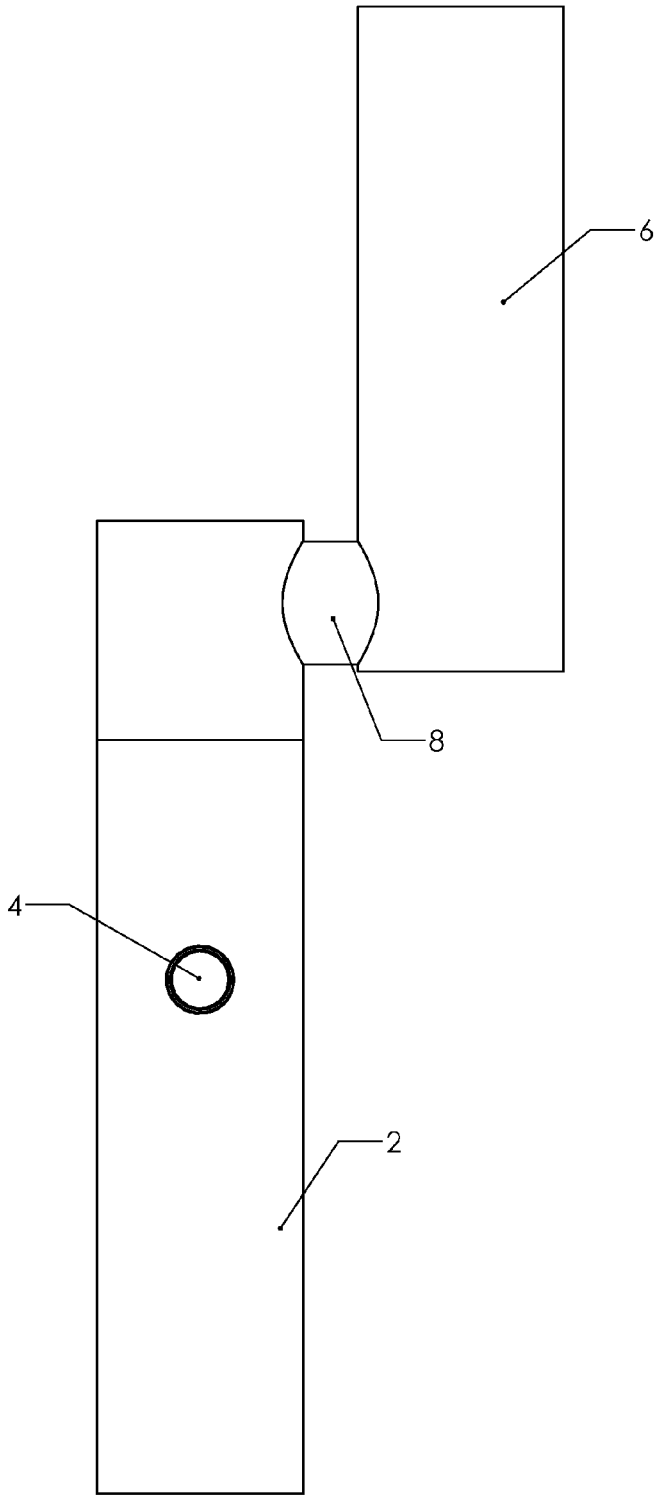
FIG. 2 is a front view of a compact vaporizer consistent with the preferred embodiment of the present invention.

As depicted in FIG. 2, the preferred embodiment compact vaporizer includes a battery housed within a battery casing 2 and a mouthpiece 6. Disposed on the battery casing is a large button 4 that enables a user to activate a heating element (discussed below). Connection cylinder 8 connects the mouthpiece 6 to battery casing 2, and provides for an air pathway from the mouthpiece 6 to the vaporized substance (discussed below). Disposed on the bottom of the battery casing 2 is a charging connection that enables the battery to be recharged through connection to an electrical source. The charging connection may be of any type, but USB is preferred because of its current universality.

Figure 3:
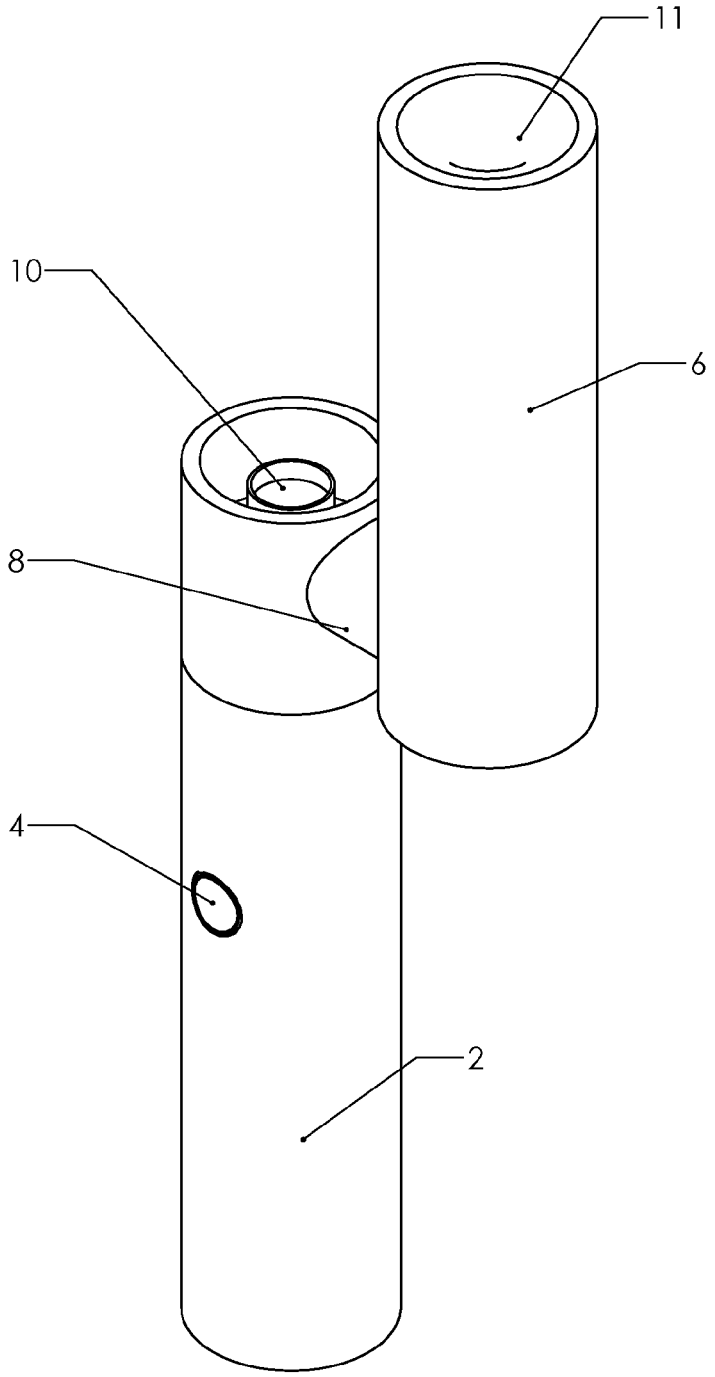
FIG. 3 is an overhead perspective view of a compact vaporizer consistent with the preferred embodiment of the present invention.

Turning to FIG. 3, disposed at the top of the mouthpiece 6 is an inhalation opening 11. Through the inhalation opening 11, the user can inhale the substance vaporized through the operation of the compact vaporizer as described herein. Disposed at the top of the battery casing, is a pan 10. As discussed more fully below, the pan is pre-heated and a user places a substance to be vaporized in the pan 10. The pan 10 is cylindrical and does not include any openings that would allow any substance placed in the pan 10 by the user to accumulate out of reach of the user or drip down out of the pan 10.

Figure 4:
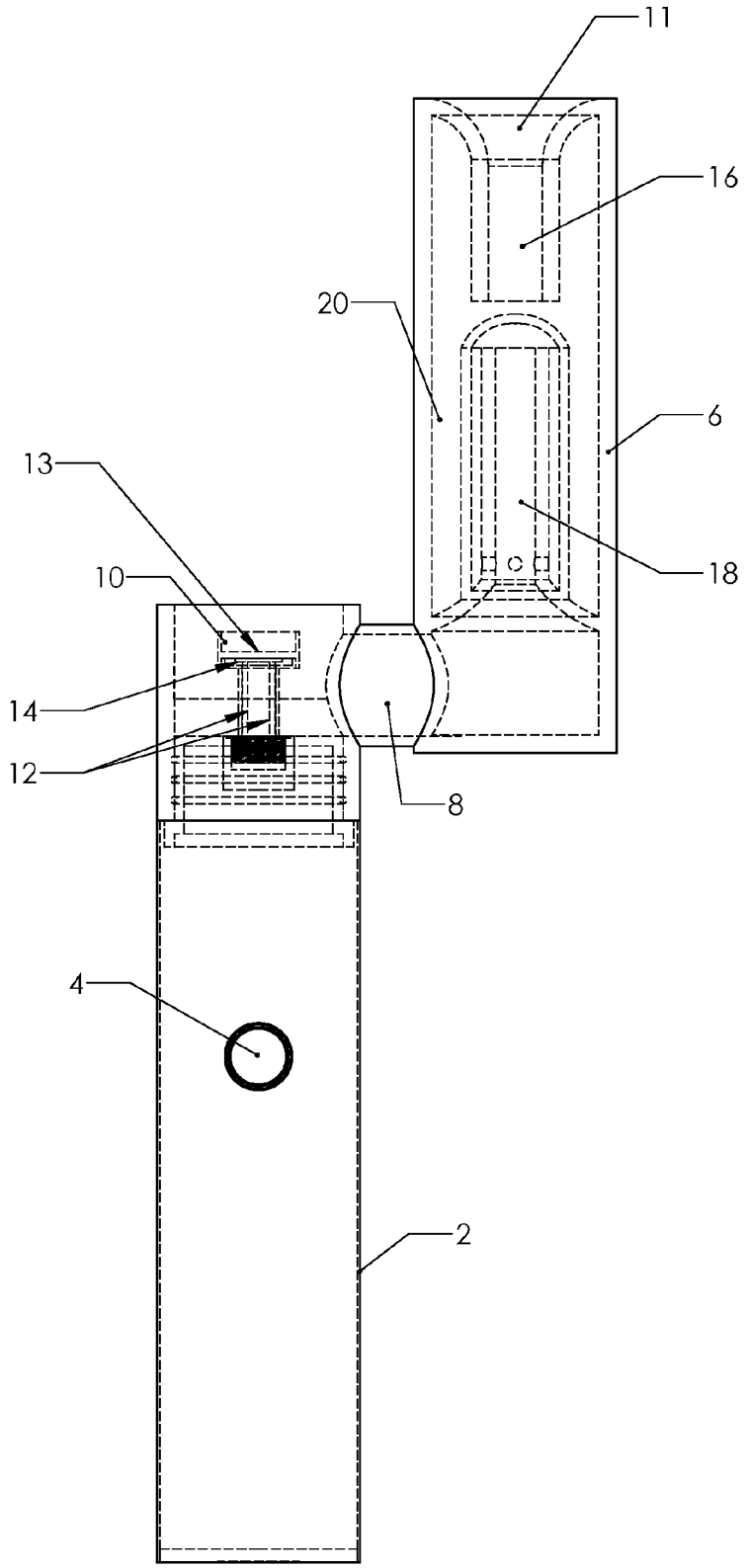
FIG. 4 is a schematic cross-sectional view of a compact vaporizer consistent with the preferred embodiment of the present invention.

Turning to FIG. 4, the mouthpiece 6 of the preferred embodiment includes an upper chamber 16 and a lower chamber 18. Both the upper chamber 16 and lower chamber 18 are generally cylindrical. The top of upper chamber 16 generally forms the inhalation opening 11 discussed above. The bottom of upper chamber 16 is open to allow the flow of air through the upper chamber 16 and the inhalation opening 11. The top and bottom of the lower chamber 18 are likewise open to allow the flow of air through the lower chamber 18. The diameter of the bottom opening of the upper chamber 16 and the diameter of the top opening of the lower chamber 18 are approximately equal to one another. The top of the lower chamber 18 is disposed approximately six millimeters below the bottom of the upper chamber 16. Surrounding the upper chamber 16 and lower chamber 18, but still within the mouthpiece 6, is fluid cooling chamber 20. Because of the configuration of upper chamber 16 and lower chamber 18 within mouthpiece 6, a user may pour water or another liquid into fluid cooling chamber 20 through inhalation opening 11, but once that water or other liquid is in fluid cooling chamber 20, it will not spill out of fluid cooling chamber 20 through upper chamber 16 or lower chamber 18 unless overfilled. The liquid in the fluid cooling chamber 20 cools the vapor heated in the pan 10 as it travels through the mouthpiece 6 before it is ultimately inhaled by the user.

The pan 10 includes a pan surface 13, on which a user may place a substance desired to be vaporized. In thermal contact with pan surface 13, disposed immediately below pan surface 13 is a heating element 14. The heating element 14 may be of any conventional type, such as a resistor heating coil, that heats up when electrical current is supplied to it. The pan surface 13 of the preferred embodiment may be any suitable material capable of withstanding heat and repeated changes in temperature, but is preferably metallic or ceramic. Heating element 14 is connected to a battery (not shown) within the battery casing 2 by two battery leads 12. Battery leads 12 provide electrical communication between the battery and the heating element 14. The electrical properties of the battery and heating element 14 (e.g. voltage and resistance) should be selected so as to cause the pan surface 13 to be heated to a temperature sufficient to vaporize a suitable substance, such as wax or oil, but not so high as to combust that substance. The pan 10 is preferably made of materials that will not react chemically with substance commonly used in vaporizes, and can withstand high and repeatedly changing temperatures. Optionally, the pan surface 13 may be surrounded, except on the top, by an insulator, made of a low density material that is not a good conductor of heat.

Optionally, a temperature sensor may be provided on or near the pan surface to provide temperature feedback to a controller, such as a microprocessor, housed in the battery casing 2. The temperature sensor is in electrical communication with the controller. Based on the feedback received from the temperature sensor, the controller may control the electrical current from the battery to the heating element 14, to ensure that the temperature of the pan surface 13 is maintained at a suitable temperature to vaporize, but not combust, the substance desired to be vaporized.

An unobstructed air pathway exists between inhalation opening 11 and pan 10, through upper chamber 16, lower chamber 18 and connection cylinder 8. Therefore when a user inhales at inhalation opening 11, the vapor created by pan 10 travels from the pan 10 to the connection cylinder 8, then to the lower chamber 18 where it is cooled by the liquid in the fluid cooling chamber 20, then to the upper chamber 16, and then finally to the inhalation opening 11.

Figure 5:
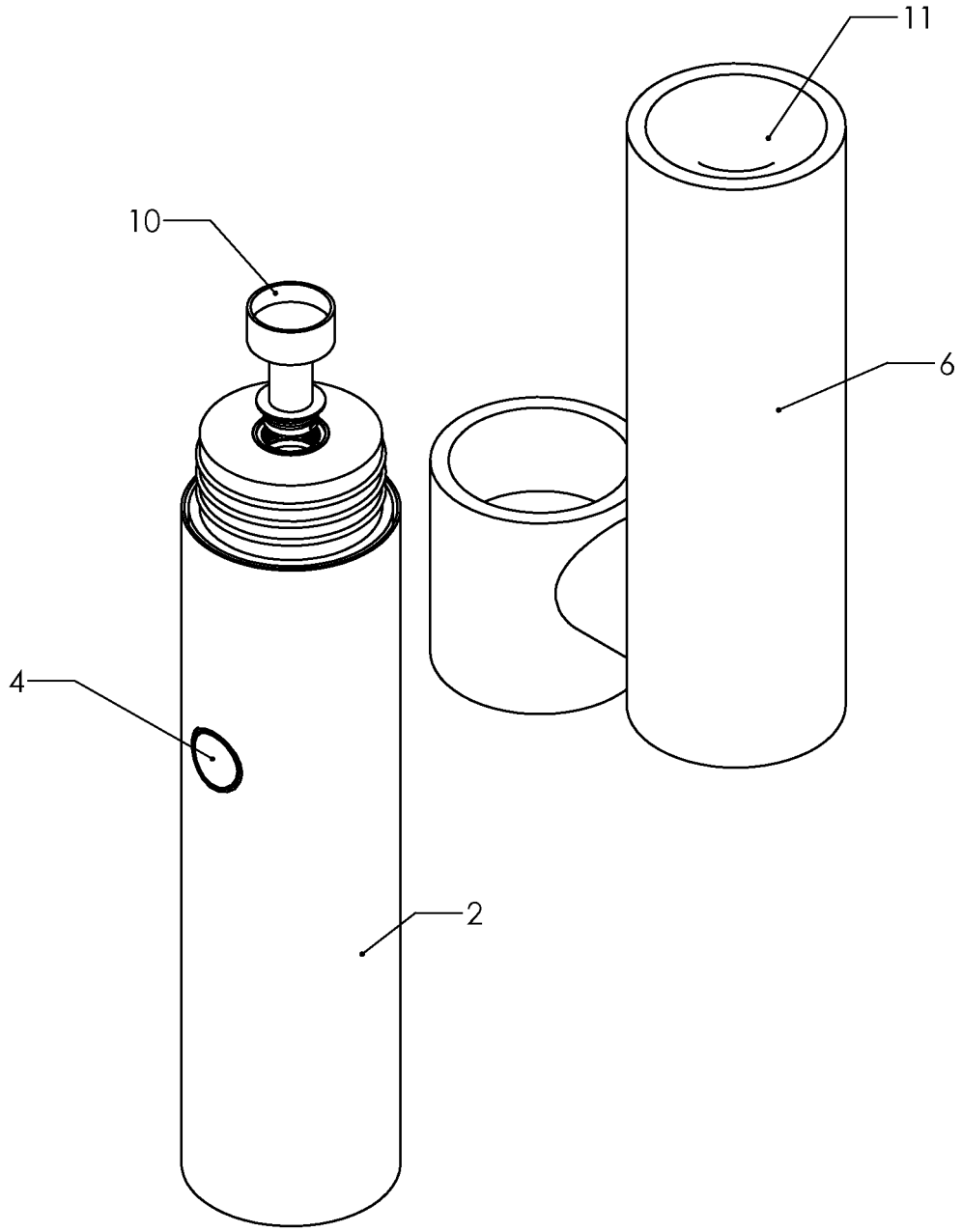
FIG. 5 is an overhead perspective view of a compact vaporizer consistent with the preferred embodiment of the present invention, with certain components detached from one another.
Figure 6:
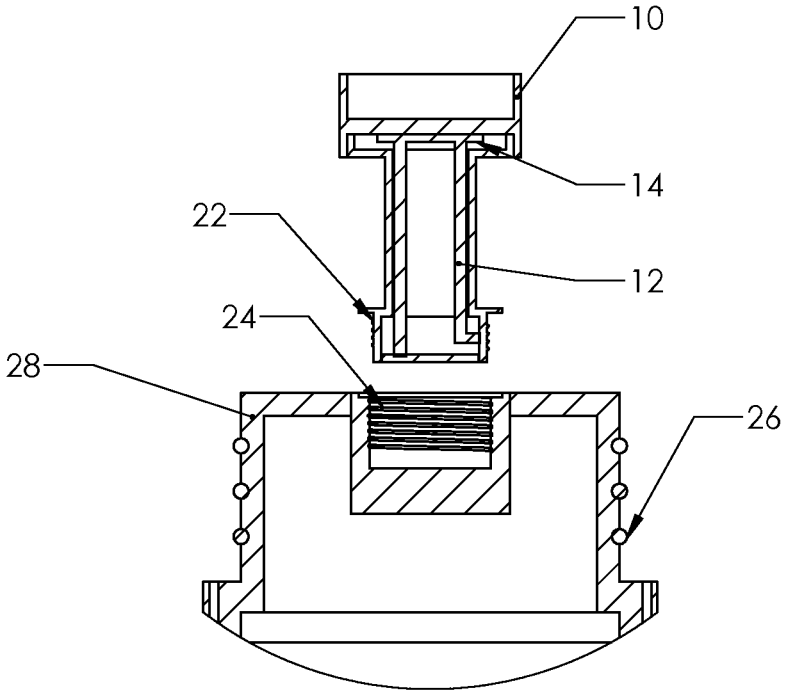
FIG. 6 is a schematic cross-sectional view of a pan of a compact vaporizer consistent with the preferred embodiment of the present invention, with certain components detached from one another, as well as the means for connecting components of the compact vaporizer.

Turning to FIGS. 5 and 6, the pan 10 is removably attached to the battery casing by a gasket ring connection (exterior rings 22 are provided on pan 10 and interior rings 24 are provided on battery casing 2) or other suitable connection means. The gasket ring connection allows the pan 10 to be easily secured and removed by no more than ten pounds of force in a direction longitudinal to the length of the battery casing 2. The means of connecting the pan 10 to the battery casing must ensure an electrical connection between 12 and the battery when the pan is in a position fully engaged with the battery casing 2. Those skilled in the art will recognized that there are a number of different mechanisms and configurations that enable a suitable removable connection pan 10 and battery casing 2.

A pan protector 28 is also provided. The pan protector 28 is threaded on its interior to enable it to engage with the exterior thread 26 of the battery casing 2. Those skilled in the art will recognize that there are a number of different mechanisms and configurations that enable a suitable removable connection between pan protector 28 and battery casing 2. The pan protector 28, particularly the top portion that is above the threaded connection with the battery casing 2, provides for additional safety as it keeps the pan 10, which may be heated to high temperatures, from coming into contact with foreign objects, even if the compact vaporizer is dropped or tipped over. Alternatively, a hinge or other rotatable connection may be provided to enable the mouthpiece 6 to connect directly to the pan protector 28, or the mouthpiece may rotatably connect directly to the mouthpiece, rather than being offset by the connection cylinder 8 when the user is inhaling through the inhalation opening 11.

Particularly because it includes a heating element 14, the pan 10 is the most likely component of the compact vaporizer to fail after several uses. The pan 10 is also less expensive to manufacture than the battery casing 2, mouthpiece 6, and components therein. Therefore, by providing means for easily connecting and disconnecting the pan 10, the preferred embodiment of the present invention provides for economical replacement of the pan 10 without replacing the rest of the compact vaporizer.

It is understood that many modifications and variations may be devised given the above description of the principles of the invention and a preferred embodiment of the invention. It is intended that all such modifications and variations be considered within the spirit and scope of this invention, as defined by the following claims.

The invention claimed is:

1. A vaporizer comprising:

an electrical source;

a mouthpiece, wherein said mouthpiece comprises a first chamber and a second chamber, and wherein the second chamber is filled with a cooling liquid, and a portion of said first chamber is surrounded by said cooling liquid;

a pan comprising a heating element, fully enclosed within said pan, in electrical communication with said electrical source, wherein said pan has no holes or passages that would allow a heated liquid or suspension material to accumulate therein, and said pan is configured relative to said mouthpiece such that an air pathway exists between said pan and said mouthpiece for a user to inhale a substance vaporized by said pan.

2. The vaporizer of claim 1 wherein said mouthpiece further comprises a third chamber separated from said first chamber and disposed above said first chamber on the same longitudinal axis as said first chamber.

3. The vaporizer of claim 2 wherein said first chamber and said third chamber are separated by at least 1 millimeter and no more than 9 millimeters.

4. A method for inhaling a vapor comprising the steps of:

placing a liquid or suspension material on the top surface of a pan;

heating the top surface of said pan by providing electrical power from an electrical source to a heating element housed within said pan;

providing negative pressure at an inhalation opening of a mouthpiece in airway communication with said top surface of said pan; and cooling said material with a cooling liquid as it travels through said mouthpiece.

5. The method for inhaling a vapor of claim 4, wherein the top surface of said pan is heated to a pre-selected temperature.

* * * * *